US008855168B2

(12) United States Patent
Raffner et al.

(10) Patent No.: US 8,855,168 B2
(45) Date of Patent: Oct. 7, 2014

(54) CHANNEL ELECTRIC INDUCTOR ASSEMBLY

(75) Inventors: Bernard M. Raffner, Moorestown, NJ (US); Karen Sarkissian, Langhorne, PA (US)

(73) Assignee: Inductotherm Corp., Rancocas, NJ (US)

( * ) Notice: Subject to any disclaimer, the term of this patent is extended or adjusted under 35 U.S.C. 154(b) by 694 days.

(21) Appl. No.: 11/735,771

(22) Filed: Apr. 16, 2007

(65) Prior Publication Data

US 2008/0253425 A1 Oct. 16, 2008

(51) Int. Cl.

| | |
|---|---|
| ***H05B 6/16*** | (2006.01) |
| ***F27B 14/06*** | (2006.01) |
| ***H05B 6/20*** | (2006.01) |

(52) U.S. Cl.

CPC ..... *F27B 14/065* (2013.01); *H05B 6/20* (2013.01)

USPC ..... 373/159; 373/161; 373/162; 373/164

(58) Field of Classification Search

USPC ..... 373/156, 159, 163, 4, 7, 160, 161, 162, 373/164

See application file for complete search history.

(56) References Cited

U.S. PATENT DOCUMENTS

| | | | | |
|---|---|---|---|---|
| 1,598,236 | A | 8/1926 | Brayton, Jr. | |
| 1,598,326 | A | 8/1926 | Stillman | |
| 3,794,101 | A * | 2/1974 | Frederick | 164/68.1 |
| 3,994,346 | A * | 11/1976 | Brown | 164/361 |
| 5,134,629 | A | 7/1992 | Cullan | |
| 5,953,363 | A | 9/1999 | Cao | |
| 6,149,844 | A * | 11/2000 | Graham | 264/71 |
| 6,208,682 | B1 | 3/2001 | Archenholtz et al. | |
| 6,743,382 | B2 | 6/2004 | Opatt et al. | |
| 2003/0140651 | A1 * | 7/2003 | Takeuchi et al. | 62/500 |
| 2005/0022957 | A1 * | 2/2005 | Crafton et al. | 164/5 |
| 2005/0184416 | A1 * | 8/2005 | McCollum | 264/40.5 |

FOREIGN PATENT DOCUMENTS

| | | |
|---|---|---|
| EP | 0069094 A1 | 1/1983 |
| EP | 0442345 A2 | 8/1991 |
| JP | 52-86745 A | 6/1977 |

* cited by examiner

*Primary Examiner* — Henry Yuen
*Assistant Examiner* — Hung D Nguyen
(74) *Attorney, Agent, or Firm* — Philip O. Post

(57) ABSTRACT

The present invention relates to an electric channel inductor assembly and method of forming an electric channel inductor assembly. A nonremovable, hollow, nonmagnetic channel mold is used to form the one or more flow channels of the assembly. A heated fluid medium is circulated in the hollow interior of the mold after the mold is situated in the assembly to heat treat the refractory surrounding the exterior walls of the mold. After heat treatment a liquid is supplied to the hollow interior of the mold to chemically dissolve the mold.

7 Claims, 7 Drawing Sheets

CHANNEL ELECTRIC INDUCTOR ASSEMBLY

CROSS-REFERENCE TO RELATED APPLICATIONS

Not applicable.

FIELD OF THE INVENTION

The present invention relates to a channel electric inductor assembly used with a vessel for melting or heating an electrically conductive liquid material such as a molten metal.

BACKGROUND OF THE INVENTION

A channel electric inductor assembly can be used with a vessel for holding molten metal in an industrial process. FIG. 1(*a*) illustrates in cross section, a typical channel electric inductor assembly 110. An outer shell 112 generally provides structural support for the assembly. The inner walls of the shell are lined with heat insulating refractory 114. Bushing 116, generally cylindrical in shape, serves as a housing for a coil and core assembly comprising inductor coil 118*a* and transformer core 118*b*. Bushing 116 provides support, as well as cooling, of refractory wall 114 surrounding the coil and core assembly. The exterior wall of the bushing is lined with heat insulating refractory 114. The space between the refractory adjacent to the inner walls of the shell and the refractory surrounding the bushing defines a metal flow channel. The channel electric assembly illustrated in FIG. 1(*a*) is known as a single loop type, since metal flows around the single loop formed by the coil and core assembly in bushing 116. When an ac current flows through inductor 118*a*, electrically conductive metal is inductively heated and moved through the flow channel of the loop, for example, in the direction of the arrows shown in FIG. 1(*a*). The channel electric inductor assembly 110 is typically coupled with a vessel 130 (also referred to as an upper case) for holding molten metal as illustrated in FIG. 1(*b*). The vessel may be formed from a structurally supporting outer wall 132 that is suitably lined with refractory 134. By circulation of metal from vessel 130 through the flow channel of the loop, the metal in vessel 130 can be heated or held at a desired process temperature for use in an industrial process. For example, the metal in the vessel may be a zinc composition, and a metal strip may be dipped into the vessel to zinc coat the strip.

In fabrication of the channel electric induction assembly, not only must the flow channel be created, but also the boundary walls of the flow channel, which comprise porous refractory, must be suitably prepared to withstand seepage of molten metal into the refractory. Typically the refractory wall material is sintered; that is, heat is applied to the refractory walls of the flow channel at a temperature below the melting point of the refractory composition, but at a high enough temperature to bond the particles of the refractory together at the boundary wall to form a substantially impervious boundary to molten metal moving through the flow channel. A traditional way of accomplishing the formation of the flow channel and sintering of the refractory wall material is to use a combustible channel mold, such as a mold formed from wood, for the flow channel. The mold is shaped to conform to the volume of the flow channel of the loop. After refractory is installed around the combustible channel mold, the mold is ignited and burned to remove the mold by combustion, and also to sinter the refractory walls of the flow channel by the heat of combustion. This is referred to as using a combustible mold. A disadvantage of this method is that the rate of combustion throughout the entire volume of the channel mold is not generally controllable. Therefore the degree of sintering of the refractory wall along the entire flow channel is not of consistent quality, and local areas of improperly sintered refractory wall results. Seepage of molten metal from the flow channel into refractory 114 can result in metal leakage to the outer shell and/or to the inductor coil and core assembly, which can cause premature failure of the channel electric inductor assembly.

A nonremovable channel mold can be formed, for example, from an electrically conductive metal. After assembly of the channel electric inductor assembly with the electrically conductive metal mold positioned in what will become the flow channel, an ac current is applied to inductor coil 118*a* to inductively melt the electrically conductive channel mold. A disadvantage of this method is that electric induction heating and melting of the electrically conductive metal mold makes it difficult to reach sintering temperature of the refractory before the mold melts. Further the mold may be formed from welded sections, and rapid induction melting of the welds will cause sections of the mold to inductively melt in an irregular manner. Therefore, there is the need for a channel electric inductor assembly with a nonremovable channel mold that can be used to properly sinter the refractory walls of the flow channel and then be satisfactorily consumed.

SUMMARY OF THE INVENTION

In one aspect the present invention is a channel electric inductor assembly having a nonremovable channel mold formed from a hollow, substantially nonmagnetic composition.

In another aspect the present invention is a method of forming a channel electric inductor assembly. A nonremovable hollow and substantially nonmagnetic channel mold is disposed in the volume forming one or more flow channels of the assembly. A heated fluid medium is circulated through the interior of the hollow mold to heat the walls of the mold whereby the refractory walls exterior to the mold are heated generally by conduction of heat from the walls of the mold to heat treat the refractory walls. A charge of material is supplied to the interior of the hollow mold to chemically dissolve the mold. AC current flowing through the one or more inductors of the assembly electromagnetically can circulate the charge, with the dissolved mold, through the flow channels to form one or more flow channels with sintered walls.

The above, and other aspects of the invention, are further set forth in this specification and the appended claims.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 1A:
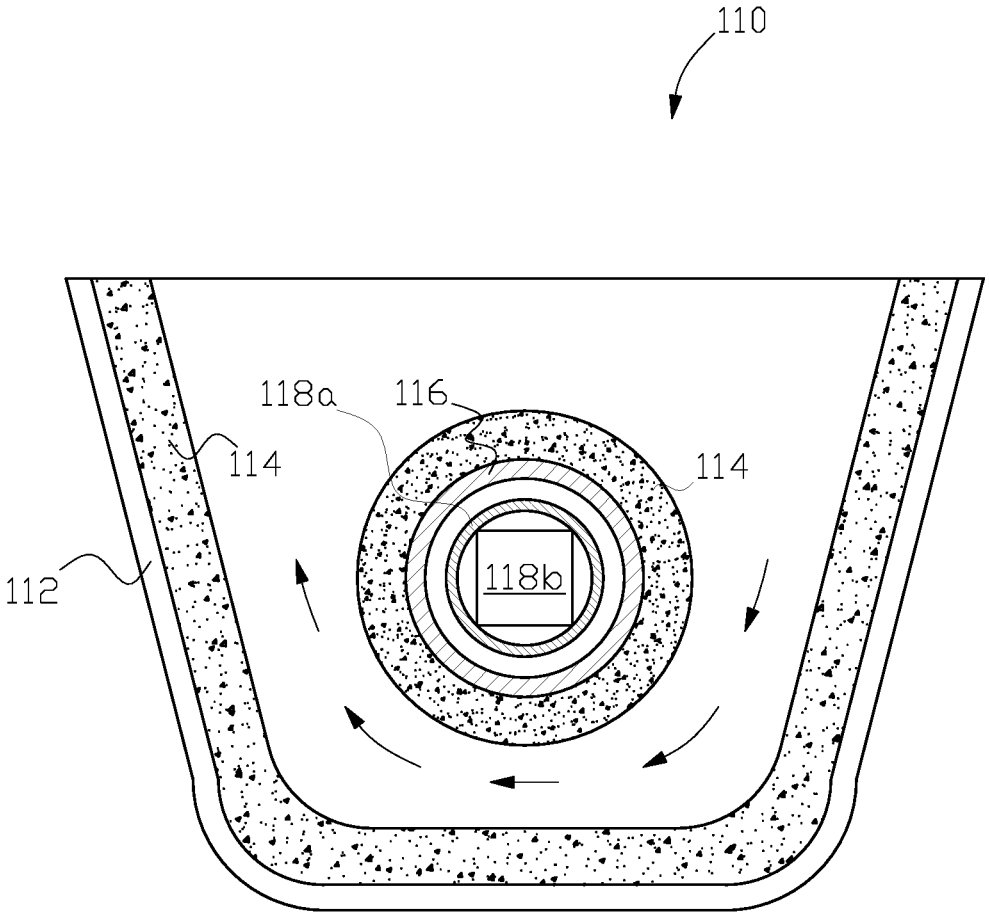
FIG. 1(*a*) illustrates in cross sectional elevation a typical single loop channel electric inductor assembly, and FIG. 1(*b*) illustrates the inductor assembly in FIG. 1(*a*) coupled with a vessel for holding molten metal.
Figure 1B:
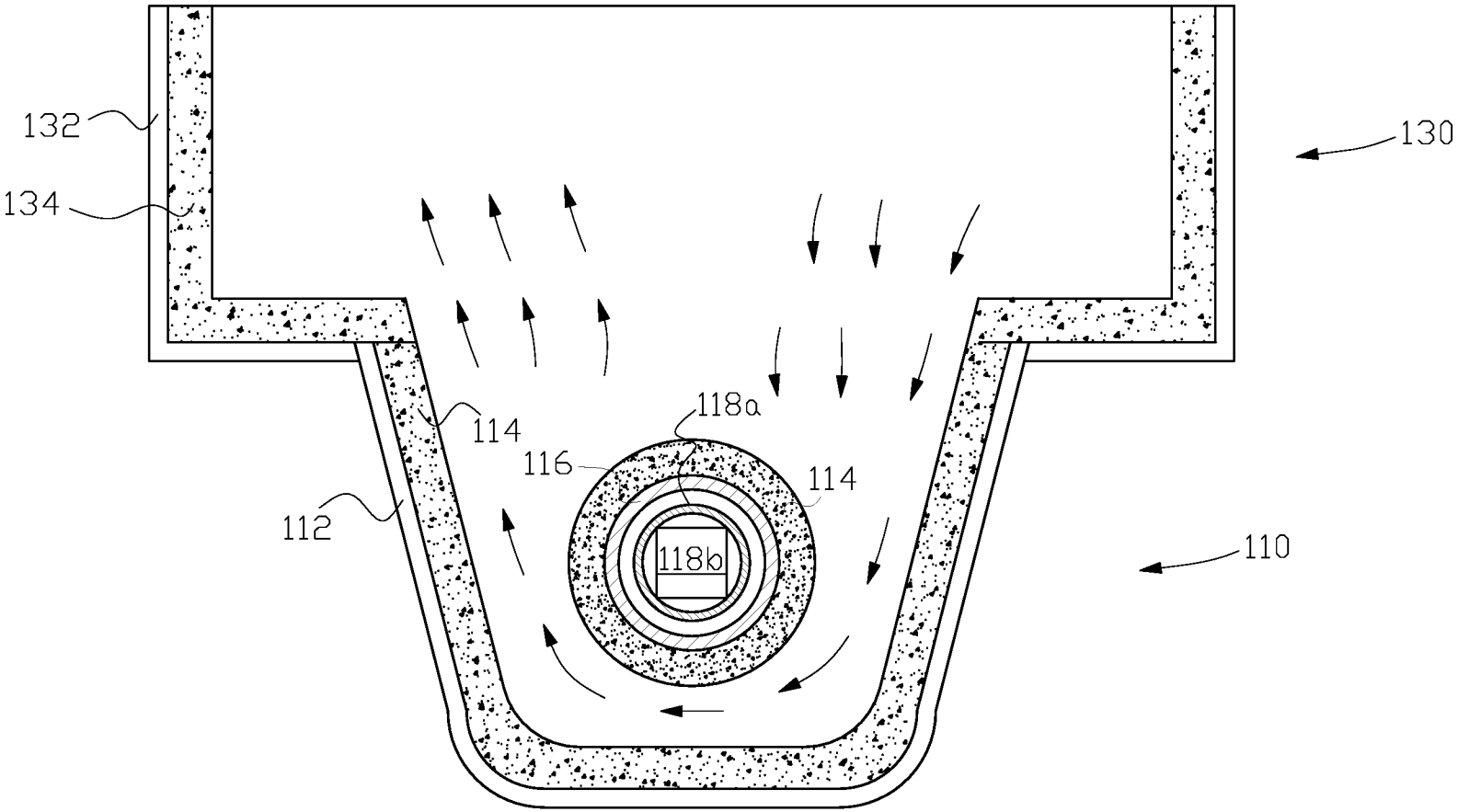
Figure 2:
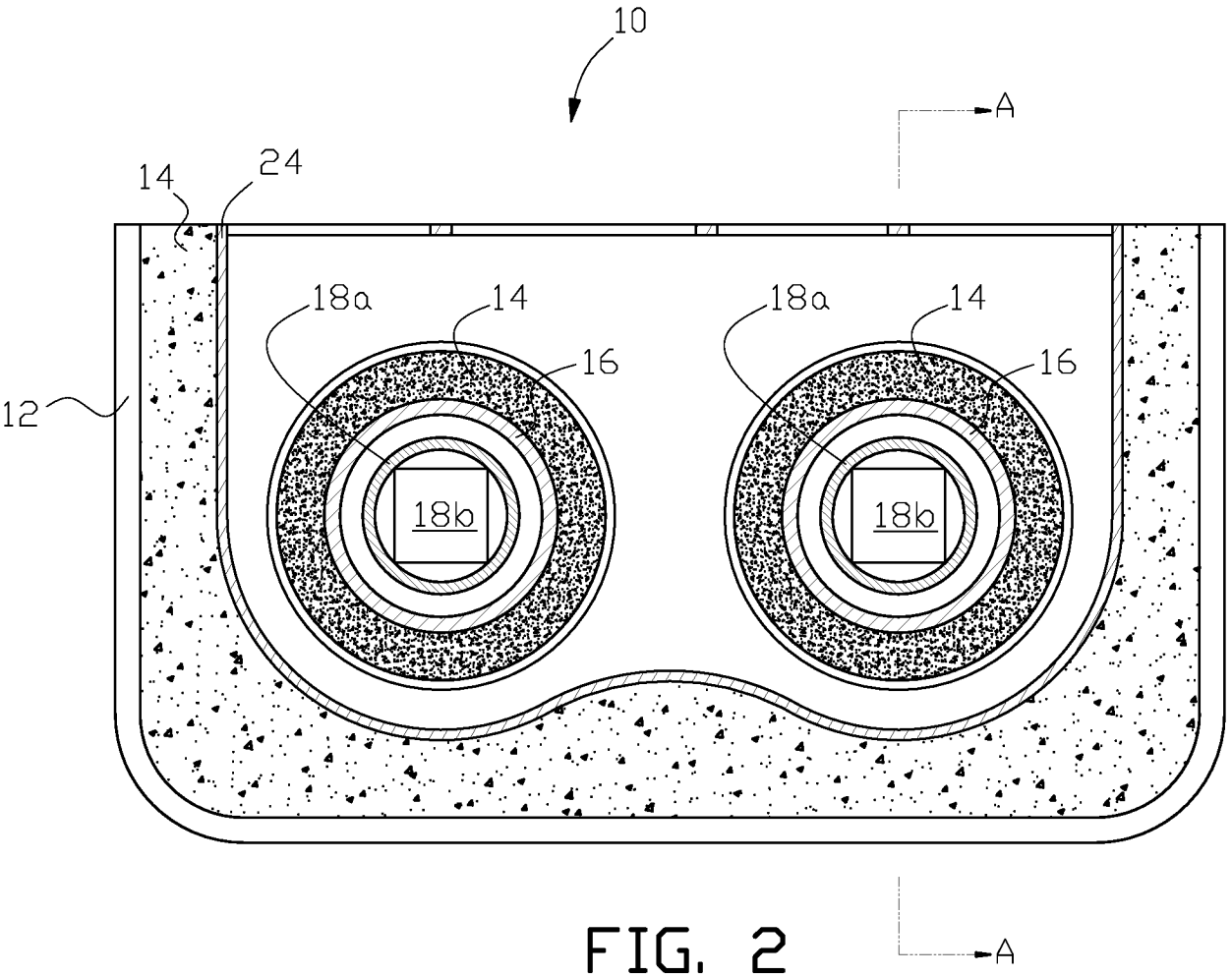
FIG. 2 is a cross sectional elevation view of one example of the channel electric inductor assembly of the present invention.

There is illustrated in FIG. 2 one example of the channel electric inductor assembly 10 of the present invention. While the channel electric inductor assembly is illustrated as a double loop type (that is, two flow channels around two inductor coil and core assemblies, with each assembly in a separate bushing), the invention is not limited to the number of loops, and the channel electric inductor assembly may have a single loop or more than two loops.

Figure 3A:
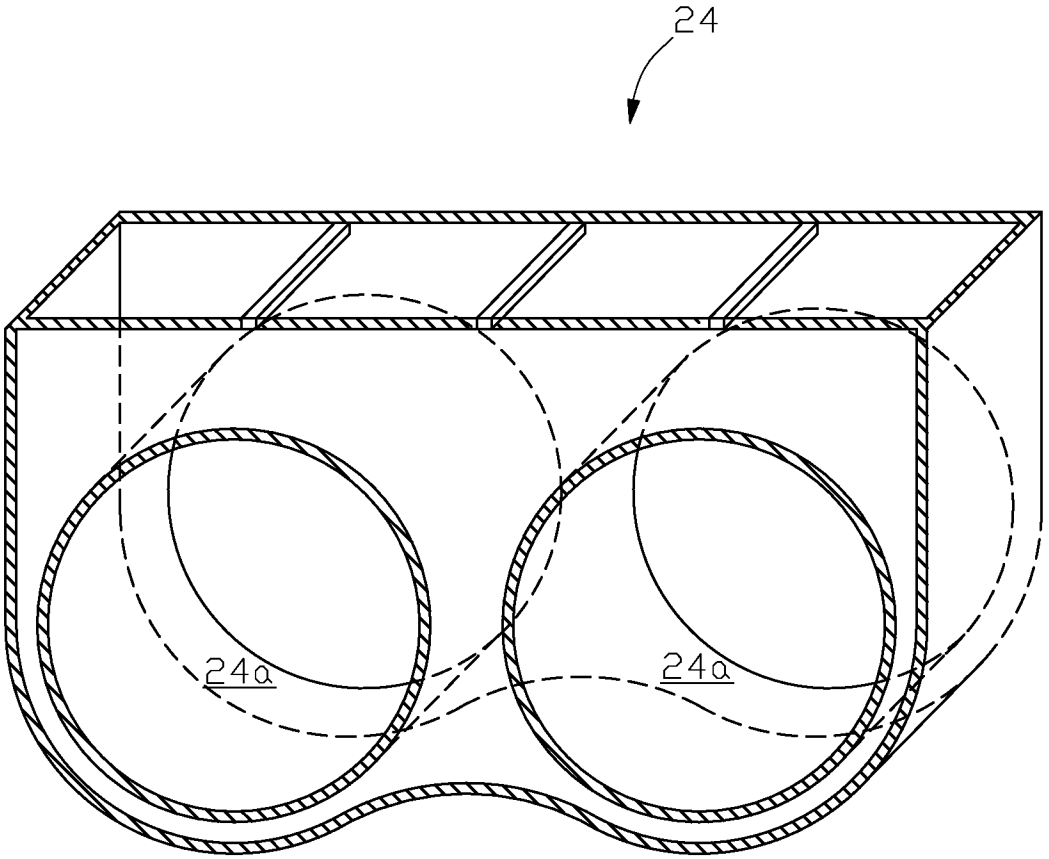
FIG. 3(*a*) and FIG. 3(*b*) illustrate one example of a nonremovable channel mold used in the channel inductor assembly of the present invention.
Figure 3B:
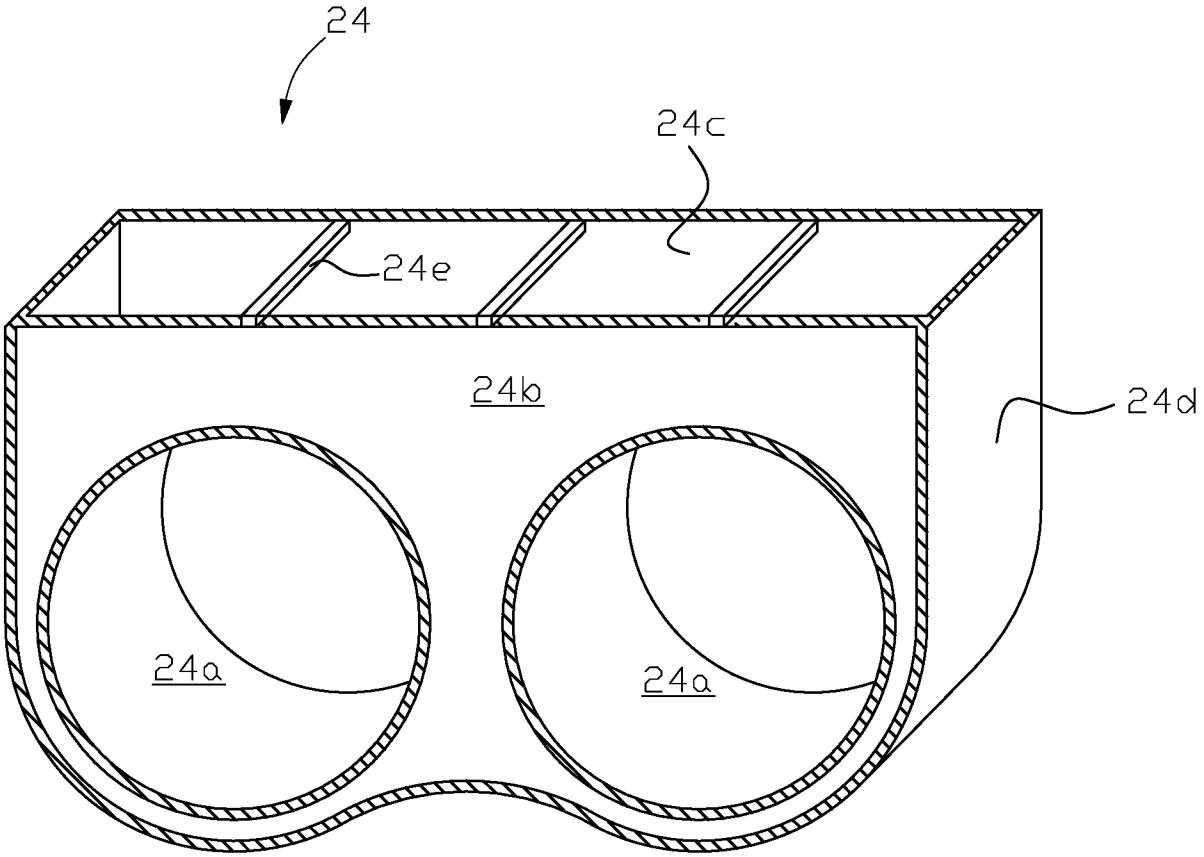

Inductor assembly 10 comprises outer shell 12; refractory 14, which at least partially lines the inner walls of the shell; two bushings 16 within each of which, one of the two inductor coil and core assemblies (each comprising inductor coil 18*a* and transformer core 18*b*) is located; refractory 14 surrounding the outer surfaces of bushings 16; and hollow, nonmagnetic metal channel mold 24, which is positioned in the volume that will serve as the double loop flow channel. FIG. 3(*a*) and FIG. 3(*b*) illustrate one non-limiting example of mold 24, with FIG. 3(*a*) showing interior features of the mold (in dashed lines), and FIG. 3(*b*) showing the exterior of the mold design. In this non-limiting example, mold 24 has two open cylindrical tunnels 24*a* in which refractory 14, bushings 16 and the coil and core assemblies are disposed. The volume between the exterior surfaces of the tunnels and the inside of the exterior walls (e.g. wall regions 24*b*, 24*c* and 24*d*) of the mold define the hollow interior volume of the mold. The top of mold 24 can be generally open, and if necessary, one or more cross bracing elements 24*e* may be provided across the top of the mold. The mold is formed from a nonmagnetic material so that it will not generally be melted by electric induction when ac current is applied to coils 18*a*. The composition of the mold is selected so that the mold will chemically dissolve by reaction with a liquid introduced into the hollow volume of the mold as further described below. Mold 24 may be of other shapes to suit the desired location and volume of the one or more flow channels that the mold will form. For example the mold may be formed to provide a generally oval, rather than rectangular, cross sectional flow channel around selected regions of the one or more bushings. Minimum wall thickness of the hollow mold is generally selected to provide sufficient structural integrity of the mold and sufficient heat transfer characteristics from the mold to refractory surrounding the outside of the mold as further described below.

Figures 4A, 4B, 4C:
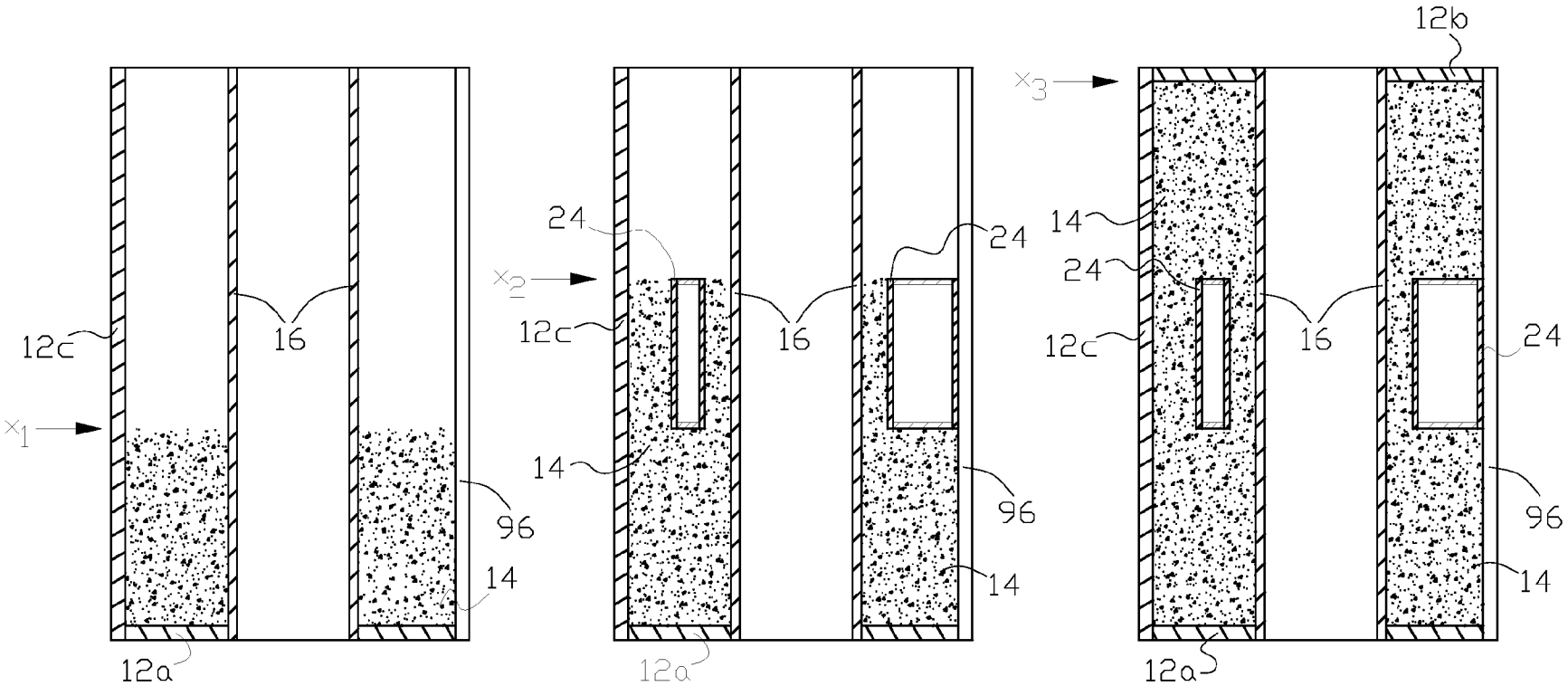
FIG. 4(*a*), 4(*b*) and 4(*c*) are cross sections through line A-A in FIG. 2 and illustrate one example of a method of constructing a channel electric inductor assembly of the present invention.

One non-limiting method of forming the channel electric inductor assembly of the present invention is disclosed with reference to FIG. 4(*a*), FIG. 4(*b*) and FIG. 4(*c*) wherein formation of the inductor assembly is accomplished with the inductor assembly initially laying on its side. Referring to FIG. 4(*a*), the outer shell, which may be formed from structural steel, initially has first shell side wall 12*a* horizontally oriented and shell bottom 12*c* vertically oriented. One or more bushings 16 can be positioned in the shell in the desired locations as shown in FIG. 4(*a*). Temporary form wall 96 can be used to contain refractory 14 within the channel electric inductor assembly until it is rotated to its upright position after assembly. Refractory 14 can be formed over the inside of first shell side wall 12*a* to a height of $x_1$. If a dry refractory is used, the refractory can be compacted (rammed) by vibration as refractory is incrementally added, for example, with a compacting tool.

Referring to FIG. 4(*b*), mold 24 is positioned in the volume that will form one or more flow channels as further described below. Refractory 14 can be added to height $x_2$, in the volume between the inner surface of shell bottom 12*c* and the outer walls of the mold, and between the outer surfaces of bushings 16 and the outer walls of the mold, with further compacting, if necessary, for example, with a dry refractory.

Finally referring to FIG. 4(*c*), refractory 14 can be added over the top of mold 24, to height $X_3$, with further compacting, if necessary, and opposing shell side wall 12*b* of the shell can be attached to the assembly. The channel electric inductor assembly can then be rotated to its upright position with shell bottom 12*c* horizontally oriented, and temporary form 96 can be removed from the top of the inductor assembly. Optionally the open ends of the one or more bushings may extend to the outside of side walls 12*a* and 12*b* as shown in FIG. 4(*a*), FIG. 4(*b*) and FIG. 4(*c*) so that the inductor coil and core assembly may be inserted or removed from its bushing after complete assembly of the channel electric inductor assembly. The inductor coil and core assembly may be installed in each of the one or more bushings at any suitable step in assembly of the channel electric inductor assembly.

An alternative, but non-limiting, method of forming the channel electric inductor assembly of the present invention comprises the steps of first inserting mold 24 and bushings 16 into an upright outer shell 12 (with mounted side plate 12*b*) and holding the mold in place with temporary support structures, while refractory is poured into the volume between the outer surfaces of the mold, and outer shell 12 and bushings 16. If necessary, the entire outer shell, with contained mold and bushings, can be vibrated as refractory is added to the volume, or alternatively, or in combination therewith, vibration of the refractory, if necessary, can be accomplished with a compacting tool.

Figure 5:
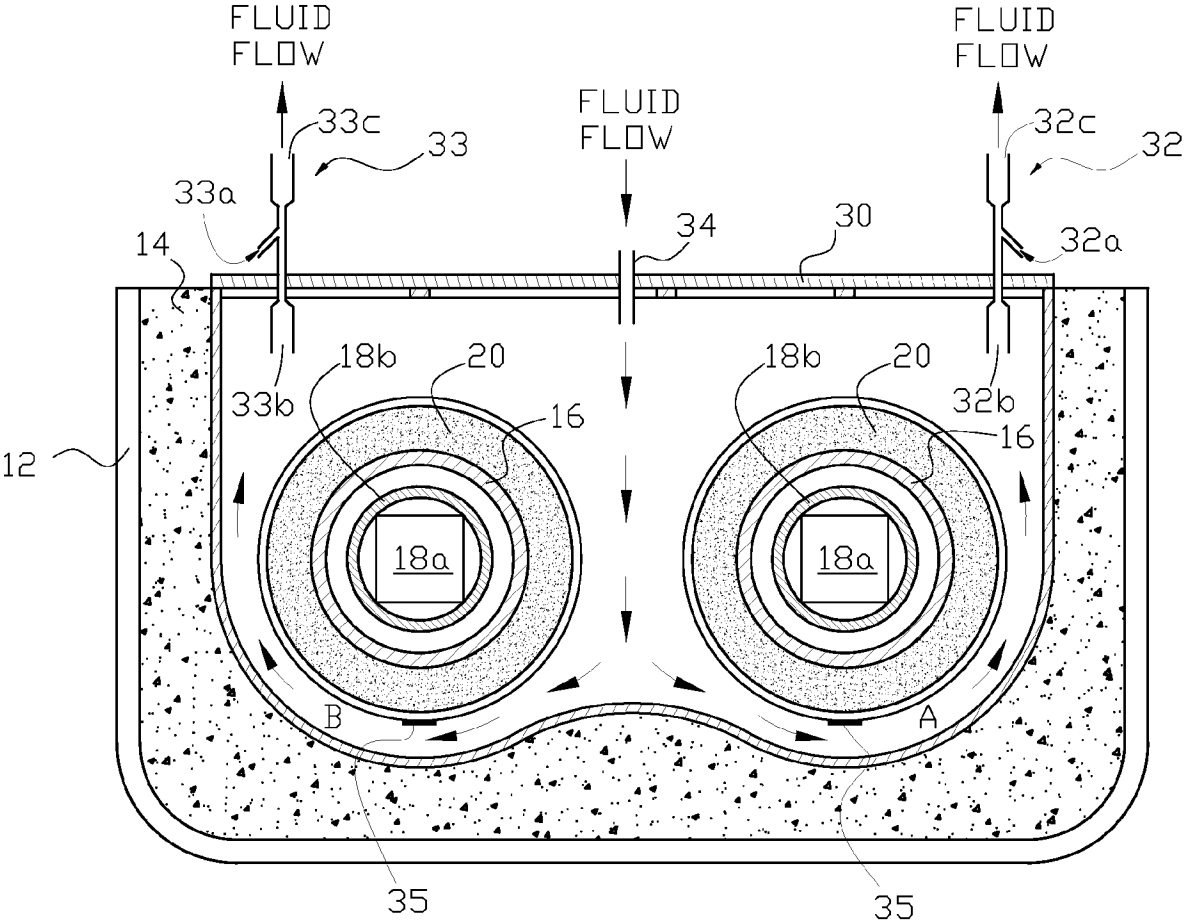
FIG. 5 illustrates one arrangement for supplying a heated fluid medium to the hollow interior of a channel mold used with the channel electric inductor assembly of the present invention.

After formation of a channel electric inductor assembly of the present invention as described above, heat treatment of the refractory adjacent to the exterior walls of the mold is accomplished. For heat treatment of the refractory adjacent to the exterior walls of the mold, a heated fluid medium, either liquid or gas, is circulated through the hollow interior of mold 24 to heat treat the refractory that will form the boundary walls of the one or more flow channels. The term "heat treatment," as used here, refers to any heat process that will cause bonding of the refractory adjacent to the exterior walls of the mold to form a substantially impervious boundary to a material that will flow through the flow channel. Typically this will be a sintering process, although the heat treatment will depend upon the particular type of refractory used in an application. Sintering may be done with the electric channel inductor assembly in any orientation; however in this example, reference is made to FIG. 5 wherein the inductor assembly is shown in the upright position. The generally open, top region of the mold can be temporarily sealed with lid 30. A suitably heated fluid medium, such as air, can be drawn into and through the hollow of the mold, for example, by a fluid pump. The fluid pump may be an ejector pump (vacuum produced by Venturi effect). For example one or more ejector pumps 32 and 33, can be provided at the top of the mold for drawing heated air into and through the hollow volume of the mold through lid 30 as shown in FIG. 5. The heated air is supplied through one or more openings 34 in the lid. A suitable ejector working fluid medium is supplied to working inlets 32*a* and 33*a* of each ejector pump, which will suck the supply of air from inlets 32*b* and 33*b* to outlets 32*c* and 33*c* respectively, by the Venturi effect, thus drawing the heated air through the hollow of the mold as diagrammatically indicated by the arrows in FIG. 5. The conduit extending into the hollow of the mold from one or more openings 34 directs the heated air into the hollow of the mold. The flow of heated air through the hollow interior of the mold heats the mold by convection, and the heated mold heats the refractory material disposed external to the walls of the mold generally by conduction. One or more suitable temperature sensing devices 35, such as thermocouples may be installed in the hollow interior of the mold to monitor selected point temperatures during the heat treatment process to ensure that suitable refractory heat treatment temperatures are achieved in selected regions. Alternatively the temperatures sensing devices may be embedded in the mold or attached to the exterior wall of the mold. Heat treatment parameters, such as the temperature or flow pressure of the heated fluid medium can be adjusted responsive to the sensed temperatures. For example, if the temperature sensing devices indicate low heat in loop A and high heat in loop B, then ejector pumps 32 and 33 can be adjusted to produce higher and lower flow velocities, respectively, through the pumps so that greater heat transfer is achieved in loop A than in loop B. The heat treatment process is continued until the flow channels' boundary walls have been sintered. Alternatively the heat treatment process may be accomplished after the channel electric inductor assembly has been attached to its upper case, and the top of the upper case, rather than the top of the electric inductor assembly can be temporally sealed to form a boundary for the supply of the fluid heated medium from and to the hollow interior of the mold as described above. While ejector pumps are used in this non-limiting example of the invention, other type of fluid flow control devices may be used in other examples of the invention.

After heat treatment of the refractory walls of the flow channel, lid 30, temperature sensing devices, if used, and associated fluid medium circulation apparatus can be removed, and a charge of electrically conductive molten metal can be supplied to the hollow interior of mold 24 to chemically dissolve the mold, preferably while ac current is supplied to the one or more inductors 18, so that as the hollow mold dissolves into molten metal, it is removed from the flow channel by electromagnetic induced flow of the electrically conductive molten metal, thereby leaving a substantially uniform heat treated refractory wall around open flow channels.

Typically, but not necessarily, the charge of electrically conductive molten metal used to chemically dissolve the hollow mold will be of similar composition to the molten metal that the electric channel inductor assembly will be used with to melt or heat in the upper case; therefore the composition of the hollow mold will be selected based upon the properties of the electrically conductive molten metal to ensure that the mold will chemically dissolve in the molten metal. By way of example and not limitation, when the charge of electrically conductive molten metal is zinc or a zinc/aluminum composition, as used for example in a galvanization process, the hollow, nonmagnetic channel mold may be composed of ¼-inch plate formed from Aluminum Association's Aluminum Standard Alloy 6061-O (untempered), which is an aluminum composition with minimum trace components of silicon, copper, magnesium and chromium that has sufficient tensile strength to serve as the channel mold. In these examples the substantially aluminum mold chemically dissolves in the molten metal.

In other examples of the invention, the liquid charge need not be a metal composition, but can be any other electrically conductive fluid material that will serve as a chemical dissolving agent for the hollow mold and will not foul the flow channels.

In other examples of the invention, the liquid charge may be a non-electrically conductive fluid material in which the hollow mold will dissolve. Subsequent to dissolving of the mold, an electrically conductive material may be supplied to the flow channels for mixing with the non-electrically conductive material in which the hollow mold has dissolved, and ac current is applied to the one or more induction coils 18*a* to remove the electrically conductive material from the flow channels.

The term "refractory" as used herein can be any material used to provide a heat resistant lining regardless of form, which may include, but is not limited to, dry bulk granular materials that may be vibrated or packed into place, and castables composed of dry aggregates and a binder that can be mixed with a liquid and poured into place.

While one mold is used in the above examples of the invention, two or more molds may be used to form multiple flow loops along the length of the channel electric induction furnace with each flow loop segregated from each other by refractory.

The above examples of the invention have been provided merely for the purpose of explanation, and are in no way to be construed as limiting of the present invention. While the invention has been described with reference to various embodiments, the words used herein are words of description and illustration, rather than words of limitations. Although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto, and changes may be made without departing from the scope of the invention in its aspects.

The invention claimed is:

1. A method of forming an electric channel inductor assembly comprising the steps of:

forming an outer shell of the a electric channel inductor assembly;

locating one or more bushings in the electric channel inductor assembly;

locating a hollow, substantially nonmagnetic, channel mold conformed to a shape of one or more flow channels between the interior wall of the outer shell and exterior surfaces of the one or more bushings, the exterior walls of the channel mold spaced apart from the interior wall of the outer shell and the exterior surfaces of the one or more bushings to form a refractory volume;

installing refractory in the refractory volume;

circulating a heated fluid medium through the hollow channel mold to heat the walls of the channel mold whereby the refractory adjacent to the outer surfaces of the hollow channel mold is subjected to a heat treatment to form a sealed refractory wall; and supplying a liquid to the hollow interior of the channel mold to chemically dissolve the hollow channel mold in the liquid.

2. The method of claim 1 wherein the heat treatment is sintering.

3. The method of claim 1 wherein the step of circulating a heated fluid medium comprises drawing the heated fluid medium through the hollow interior of the channel mold by one or more ejector pumps.

4. The method of claim 1 further comprising the steps of sensing the temperatures of the walls of the channel mold at one or more points, analyzing the sensed temperatures at the one or more points; and adjusting one or more parameters of the heated fluid medium responsive to the sensed temperatures at the one or more points.

5. The method of claim 4 wherein the step of adjusting the one or more parameters of the heated fluid medium responsive to the sensed temperatures at the one or more points is accomplished by adjusting the fluid flow rates through the one or more ejector pumps.

6. The method of claim 1 wherein the liquid is an electrically conductive liquid, the method further comprising the step of supplying an ac current to an induction coil disposed in each of the one or more bushings to heat the electrically conductive liquid and create a flow of the electrically conductive liquid to remove the chemically dissolved channel mold from the one or more flow channels of the electric channel inductor assembly.

7. The method of claim 1 wherein the liquid is a non-electrically conductive liquid, the method further comprising the steps of supplying an electrically conductive material to the one or more flow channels and supplying an ac current to an induction coil disposed in each of the one or more bushings to remove the electrically conductive material and the chemically dissolved channel mold from the one or more flow channel of the electric channel inductor assembly.

* * * * *